US007908987B2

(12) United States Patent
Grassi et al.

(10) Patent No.: US 7,908,987 B2
(45) Date of Patent: Mar. 22, 2011

(54) METHOD AND DEVICE FOR ORIENTING A TUBULAR KNITTED ARTICLES, SUCH AS A SOCK, ANGULARLY AROUND AN AXIS

(75) Inventors: Nerino Grassi, Mantova (IT); Antonio Magni, Florence (IT)

(73) Assignee: Golden Lady Company S.p.A., Jesi, Ancona (IT)

( * ) Notice: Subject to any disclaimer, the term of this patent is extended or adjusted under 35 U.S.C. 154(b) by 623 days.

(21) Appl. No.: 11/993,077

(22) PCT Filed: Jun. 16, 2006

(86) PCT No.: PCT/IT2006/000459

§ 371 (c)(1),
(2), (4) Date: Dec. 19, 2007

(87) PCT Pub. No.: WO2006/137097

PCT Pub. Date: Dec. 28, 2006

(65) Prior Publication Data

US 2010/0212564 A1 Aug. 26, 2010

(30) Foreign Application Priority Data

Jun. 23, 2005 (IT) ..... FI2005A0141

(51) Int. Cl.
*D05B 33/00* (2006.01)

(52) U.S. Cl. ..... 112/475.12; 66/148; 112/470.08

(58) Field of Classification Search ..... 112/470.08, 112/474.12, 475.04, 475.07; 66/147, 148, 66/150

See application file for complete search history.

(56) References Cited

U.S. PATENT DOCUMENTS

| | | | | |
|---|---|---|---|---|
| 5,014,634 | A * | 5/1991 | Hodges et al. | 112/475.12 |
| 5,487,281 | A * | 1/1996 | Frullini et al. | 66/13 |
| 5,606,876 | A * | 3/1997 | Sangiacomo | 66/148 |
| 6,158,367 | A | 12/2000 | Jordan et al. | |
| 6,341,570 | B2 * | 1/2002 | Fujiwara et al. | 112/475.12 |
| 6,516,979 | B1 * | 2/2003 | Migliorini | 223/75 |
| 7,044,071 | B2 * | 5/2006 | Jordan et al. | 112/470.08 |
| 7,049,621 | B2 * | 5/2006 | Bassi | 250/559.4 |
| 7,290,409 | B2 * | 11/2007 | Grassi et al. | 66/148 |
| 7,677,188 | B2 * | 3/2010 | Magni et al. | 112/470.15 |

FOREIGN PATENT DOCUMENTS

| | | |
|---|---|---|
| EP | 0 323 069 A2 | 7/1989 |
| EP | 0 635 593 | 1/1995 |
| EP | 0 679 746 | 11/1995 |
| IT | WO 02/070801 | 9/2002 |
| IT | WO 03/018891 | 3/2003 |
| IT | WO 2005/100665 | 10/2005 |

* cited by examiner

*Primary Examiner* — Danny Worrell
(74) *Attorney, Agent, or Firm* — McGlew & Tuttle, P.C.

(57) ABSTRACT

The device comprises: a tubular member (1); means (3, 5, 11) to insert and stretch a tubular knitted article (M) over the outside of said tubular member and over an end thereof; a control unit. It also comprises a crown (101) of detection elements cooperating with the end of the tubular member, and the control unit is programmed to determine the angular position of the tubular article stretched over the tubular member by reading the signal supplied by the detection elements in a definite reciprocal position of said tubular article, of said tubular member and of said detection elements.

17 Claims, 11 Drawing Sheets

P
F
1
S
M
1
4
B
11
11

Fig.10
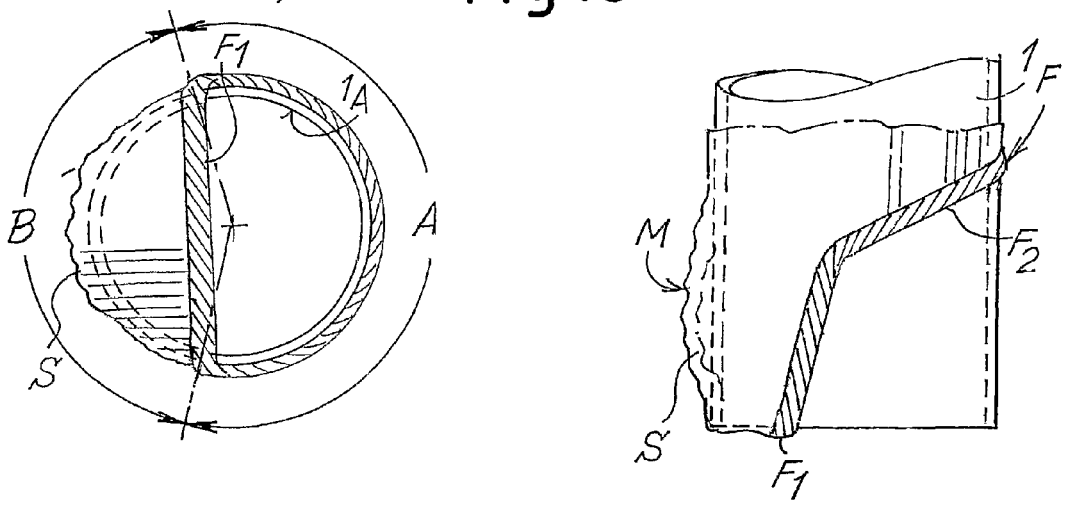
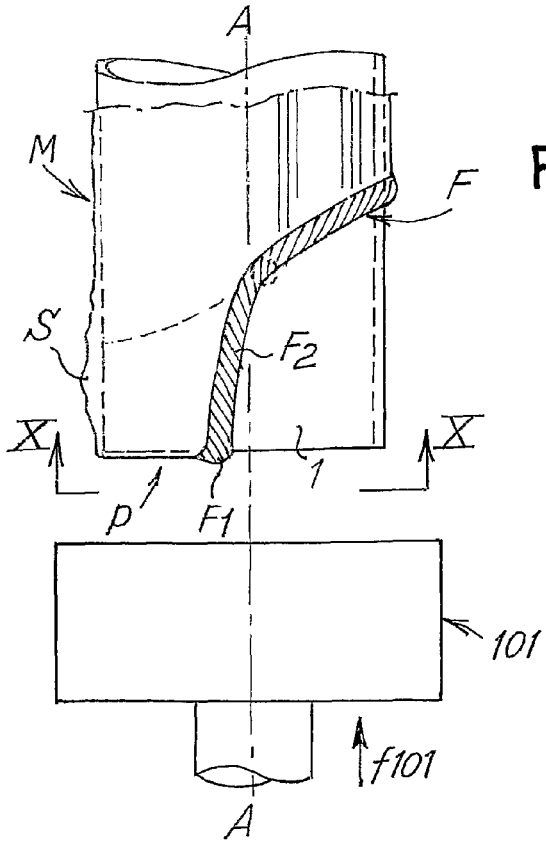
Fig.9

METHOD AND DEVICE FOR ORIENTING A TUBULAR KNITTED ARTICLES, SUCH AS A SOCK, ANGULARLY AROUND AN AXIS

TECHNICAL FIELD

The present invention relates to methods and devices for handling tubular knitted articles, in particular although not exclusively, socks and stockings.

More specifically, the present invention relates to a method for handling a tubular knitted article, such as a sock or the like, in order to orient it with respect to the heel pocket and to the toe pocket to close the toe by sewing or linking of said article.

The invention also relates to a device for implementation of said method.

PRIOR ART

To produce stockings, socks and other tubular knitted articles, circular knitting machines are commonly used; these produce—using needle beds disposed on one or two cylinders—semi-finished articles with two ends: one of these ends constitutes the elastic edge and represents the end from which the finished garment is put on. The opposite end, instead, must be sewn or linked once the semi-finished article has been unloaded from the circular machine, to produce the closed toe of said article.

Typically, the article has a first pocket of fabric for the heel and a second pocket of fabric for the toe. Some types of sporting article have no heel pocket and the article has a less modeled shape.

Devices to handle these articles until they are sewn or linked are described, for example, in WO-A-02070801 and in WO-A-03018891.

Sewing or linking with which the final end of the article is closed to form the toe must have an orientation which is pre-established with respect to the pocket of fabric, produced on the circular machine and forming the heel of the article, and/or with respect to the toe pocket, in order to guarantee correct fit of the garment. It is therefore necessary to orient the semi-finished article correctly before picking it up and inserting it in the devices that perform sewing, whether these are linking devices, sewing devices or intermediate devices destined to convey the article to a sewing or linking station.

For this purpose, according to the prior art, a band, strip or edge formed of rows of stitches characterized by an area of a different color with respect to the remaining portion of these stitches, is knitted along the edge defining the end destined to form the toe of the finished article. This area constitutes a reference mark for optical orientation sensors and is arranged in a specific position with respect to the toe pocket and/or the heel pocket. This is easily obtainable through the electronic control of the knitting machine.

By rotating the article and the sensor one with respect to the other, it is possible to locate the position of the reference mark and therefore of the toe or heel pocket. The article will therefore be engaged in a specific position with respect to the pocket, to be sewn or linked with the correct orientation.

With this method, the production of a mark that can be read by a photocell or another optical sensor has some drawbacks. Firstly, on some circular machines (in particular double cylinder circular machines) it is not easy to produce this mark. Secondly, in any case, the use of yarns of different colors to differentiate the mark from the remaining part of the edge surrounding the end of the semi-finished article to be closed involves an increase in costs and a reduction in the production rate of the circular machine.

U.S. Pat. No. 6,158,367 discloses an orientation system for socks to be sewn wherein each sock with the toe still open is inserted over a tube and positioned thereon so as to project with the toe pocket beyond the edge of the tube. A double optical sensor, comprising two transmitters and two receivers, is then positioned with respect to the sock so that the two transmitters are substantially positioned aligned with the tube over which the sock is inserted and at the level of the toe pocket. The two transmitters emit optical beams towards corresponding receivers placed outside the volume of the sock. By rotating the two pairs of transmitter-receivers about the axis of the tube, the position of the toe pocket is determined. The system illustrated in this prior art patent presupposes that the sock has a thickness, which allows the toe pocket to project from the tube without sagging. Therefore, operation is somewhat unreliable and strictly dependent on the unpredictable behavior of the fabric with which the sock is produced.

OBJECTS AND SUMMARY OF THE INVENTION

An object of the present invention is to either reduce or totally or partly eliminate the drawbacks of the prior art discussed above.

In substance, according to the invention, a method is provided to handle a tubular knitted article comprising a first open end defining an elastic edge, a second open end surrounded by a band and which must be closed, to form a closed toe of the article, along a closing line having specific orientation with respect to a pocket of fabric of the article, characterized by the steps of:

a. stretching said article over a tubular member so that an intermediate part of the band surrounding said, second end is positioned along a line intersecting in two points the end edge of the tubular member and the remaining part is disposed along the outer side surface of the tubular member;
b. positioning a crown of detection elements along the end edge of the tubular member;
c. detecting the angular position of said band on the tubular member as a function of interaction between said crown of detection elements and said band;
d. identifying the position of the pocket of fabric on the basis of the angular position of said band with respect to the tubular member.

According to an advantageous embodiment of the invention, the detection elements are positioned in front of the end edge of the tubular member.

According to an advantageous embodiment, detection is performed without reciprocal rotation between the crown of detection elements and the tubular member.

In a possible embodiment of the invention, the method is implemented using electrical contacts as detection elements, which cooperate with a tubular member made at least in part of an electrically conductive material.

The electrical contacts can all be brought into contact with the tubular member and with the tubular article stretched thereover, and the angular position of said band is determined according to the position of the electrical contacts closed through contact with the tubular member and opened through interposing the tubular article between the contacts and the tubular member. In substance, the electrical contacts are in this case positioned with a sufficiently small pitch corresponding to the minimum resolution required in determining the angular position of the tubular article. Therefore, according to the position of the closed electrical contacts and of the open electrical contacts through interposing the fabric between the contacts and the tubular member, the position of the band surrounding the toe of the article is identified with respect to the front end of the tubular member over which the article has been inserted. In this embodiment of the method according to the invention it is advantageous for the electrical contacts to be made to act simultaneously on the tubular member. Preferably, during detection the tubular article is held substantially still with respect to the tubular member. This makes the detection method more effective and more reliable.

In a preferred embodiment of the method of the invention, the tubular article is taken to a specific position with respect to the tubular member and the angular position of the tubular article is determined identifying the points of separation between the detection elements which are at the level of a surface of the tubular member covered by fabric of the tubular article and the detection elements which are at the level of a surface of the tubular member not covered by fabric of said tubular article.

The invention also relates to a device for handling tubular knitted articles, comprising: a tubular member; means to insert a tubular knitted article onto the outside of said tubular member, tensioning members to tension said tubular article inserted over said tubular member; means for angular orientation of the article; a control unit to control the operations of said device, in which the control unit is programmed to implement a method of the type defined above.

According to a different aspect, the invention relates to a device for angular orientation of a tubular knitted article, comprising: a tubular member; means to insert and stretch a tubular knitted article on the outside of said tubular member and over an end thereof; a control unit. Characteristically, according to the invention the device comprises a crown of detection elements cooperating with the end of the tubular member, said control unit being programmed to determine the angular position of the tubular article stretched over the tubular member by reading the signal supplied by said detection elements in a specific reciprocal position of said tubular article, of said tubular member and of said detection elements. The detection elements are advantageously positioned with a sufficiently small pitch, corresponding to the tolerance with which the angular position of the tubular knitted article is to be identified or determined. This allows detection to be performed without relative movement between the detection elements and the tubular knitted article, making the device simpler and more reliable, as well as more precise.

Further advantageous features and embodiments of the invention are indicated in the attached claims and will be described better with reference to a non-limiting example of the invention.

BRIEF DESCRIPTION OF THE DRAWINGS

The invention will be better understood by following the description and accompanying drawing, which shows a non-limiting practical embodiment of the invention. More specifically, in the drawing:

FIG. 9 schematically shows the layout of the article on the tubular member after reversing thereof;

FIG. 10 shows a front view according to X-X in FIG. 9;

DETAILED DESCRIPTION OF A PREFERRED EMBODIMENT OF THE INVENTION

Figure 1:
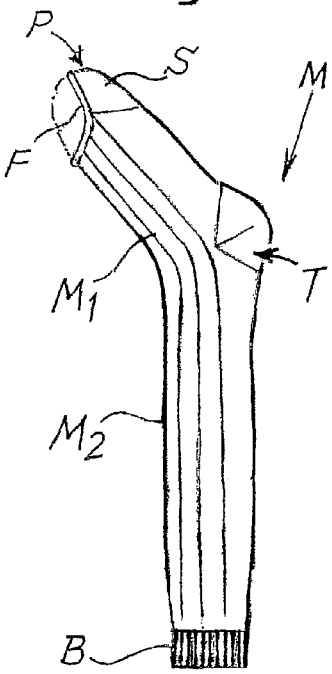
FIG. 1 shows a semi-finished article as it is unloaded from a circular machine.
Figure 2:
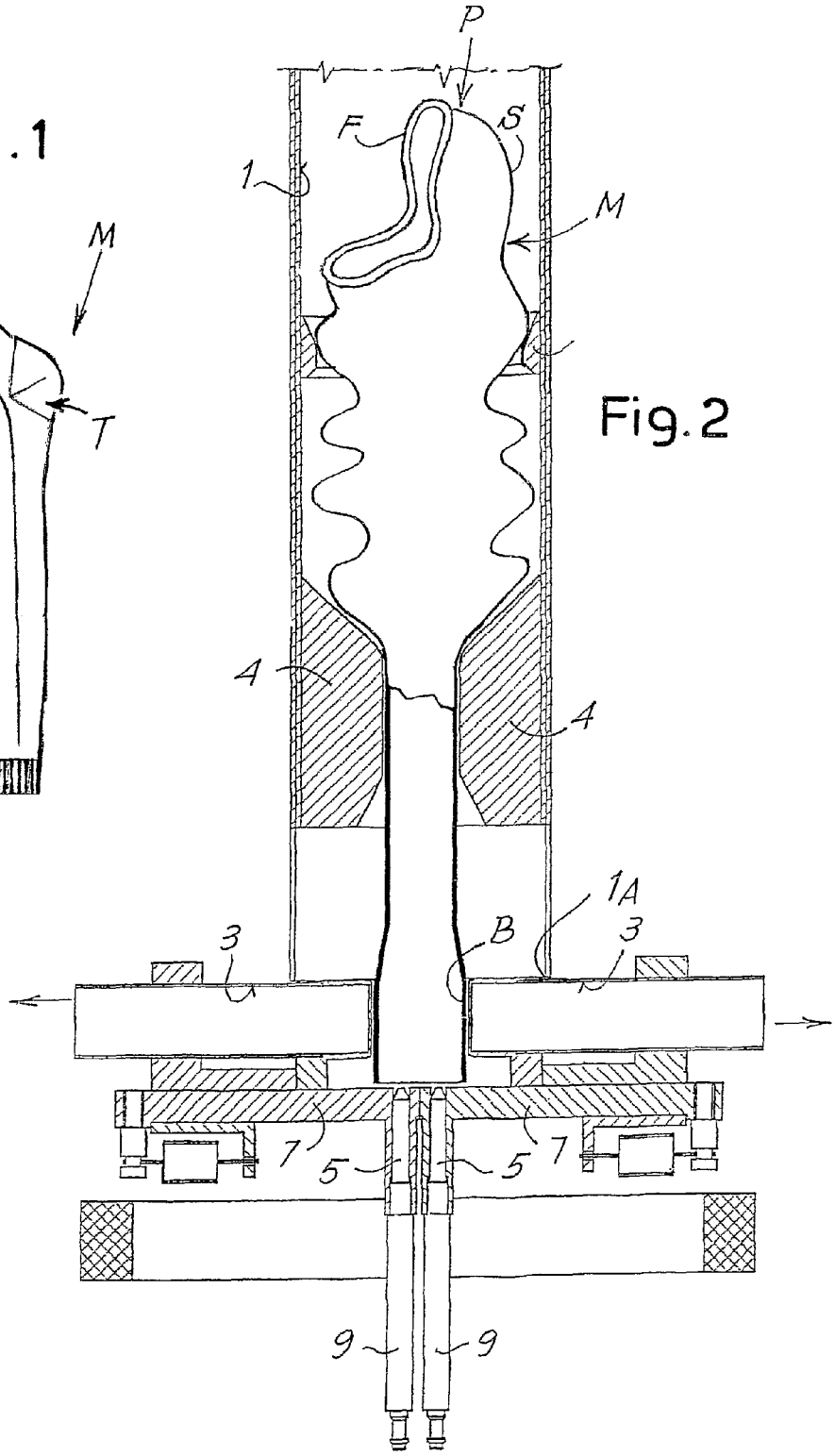
FIGS. 2 to 8 show a positioning sequence, with reversing of the article on a tubular member.
Figure 3:
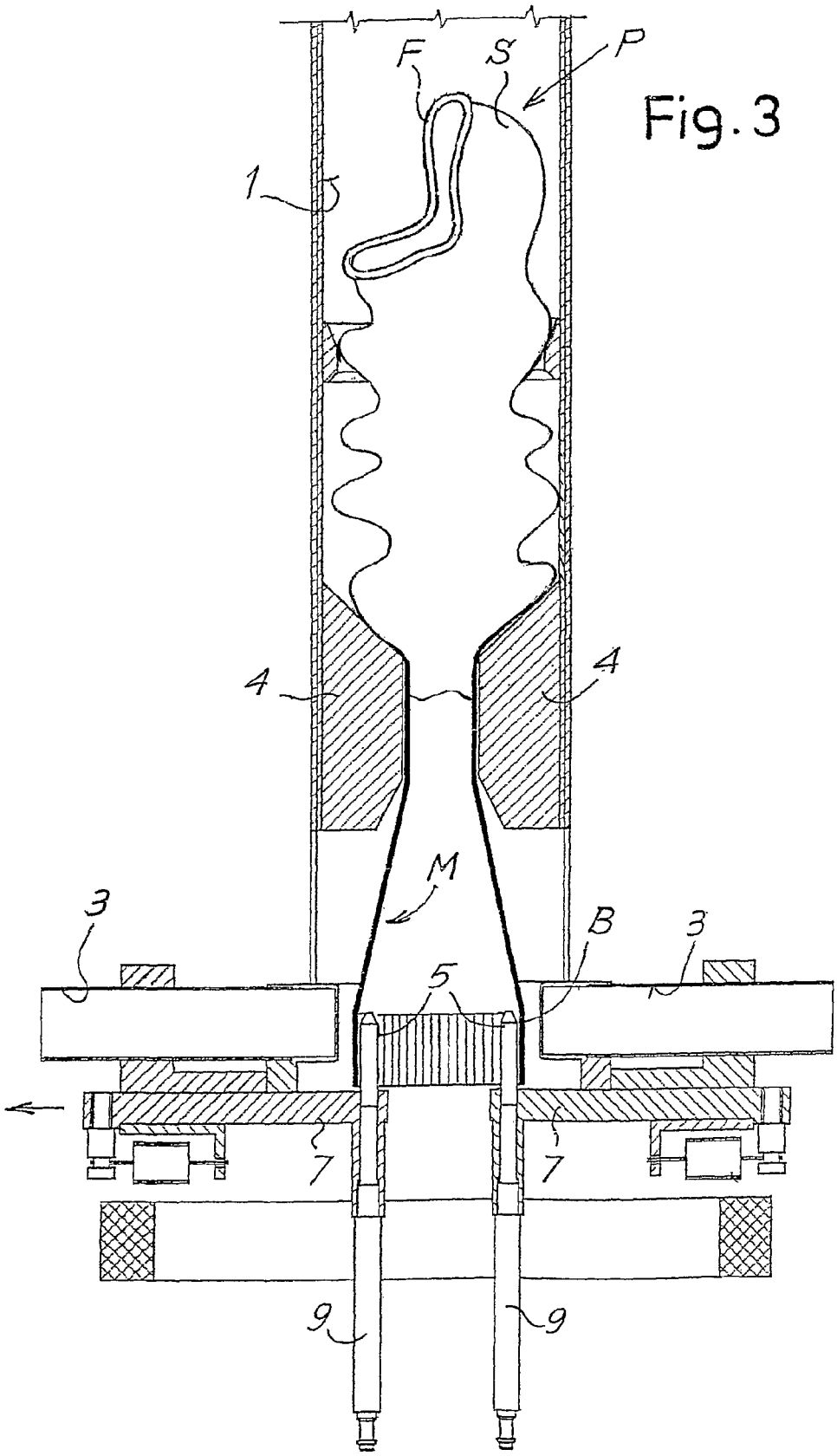

FIG. 1 schematically illustrates a semi-finished article as it is delivered from a circular machine, for example a double cylinder machine. The article is indicated as a whole with M. It has a foot and a part of leg indicated respectively with M1 and M2. The reference B indicates the elastic edge of the article, T indicates the heel pocket and P indicates the toe of the article, which is delivered open from the circular machine and must be closed by sewing or linking. Produced along the edge of the open end P is a band F, constituted by a series of rows of stitches, optionally produced with a thicker yarn than the yarn forming the remaining part of the article. The object of this band, already known to those skilled in the art, is to allow handling during sewing and it is eliminated after the toe P has been closed by sewing or linking. The band F has a different color to the adjacent area of the article M. Provided adjacent to the end opening destined to form the toe is a second pocket of fabric, indicated with S and called also toe pocket.

The two pockets T and S are used to shape the garment and to improve fit. In some cases the article can be devoid of the pocket of fabric T of the heel. The toe must be closed with a sewing or linking line oriented orthogonally to the plane in FIG. 1, that is, orthogonally to the centerline or symmetry plane of the pocket S and/or of the pocket T.

The article M is delivered from the circular machine with the right side out, that is, the surface on the outside is the one that will effectively be the outer surface of the article when it is worn. Sewing of the toe must instead be performed by turning the article inside out, so that the outer surface is the one that is normally on the inside.

For this purpose, a reversing operation is performed on a tubular member, said operation being known and represented in brief in the sequence in the successive FIGS. 2 to 8. The means used to perform this operation can vary and the one represented is only one of the possible configurations of these means. They are described in greater detail in WO-A-03018891, which should be referred to for a more accurate description. Equivalent means for this purpose are described in WO-A-02070801.

Briefly, the article M is inserted by suction in a tubular member 1 provided on the inside with profiles 4, the purpose of which is to deliver the article M to the members below, described briefly hereunder, in the most suitable position. The article M is inserted in the tubular member 1 with its elastic edge B oriented towards the opening 1A of the tubular member 1. The article can arrive directly from a suction pipe connected to a knitting machine or to a plurality of knitting machines, or can be picked up from a suitable container, into which the articles coming from one or more machines are introduced randomly.

When the elastic edge B of the article M projects from the opening 1A of the tubular member 1 (FIG. 2), gripping suction members 3 (disposed for example in a number of four equidistant from one another about the axis of the tubular member 1), with a sequence described in the aforesaid WO-A-03018891, enlarge the opening formed by the elastic edge B. Pins 5 carried on slides 7, movable radially so that they can retract from the axis of the tubular member 1, are inserted into the stretched opening. The pins 5 are controlled by pistoncylinder actuators 9, which control insertion inside the elastic edge B when the latter in the stretched position through the effect of the pneumatic members 3.

Figure 4:
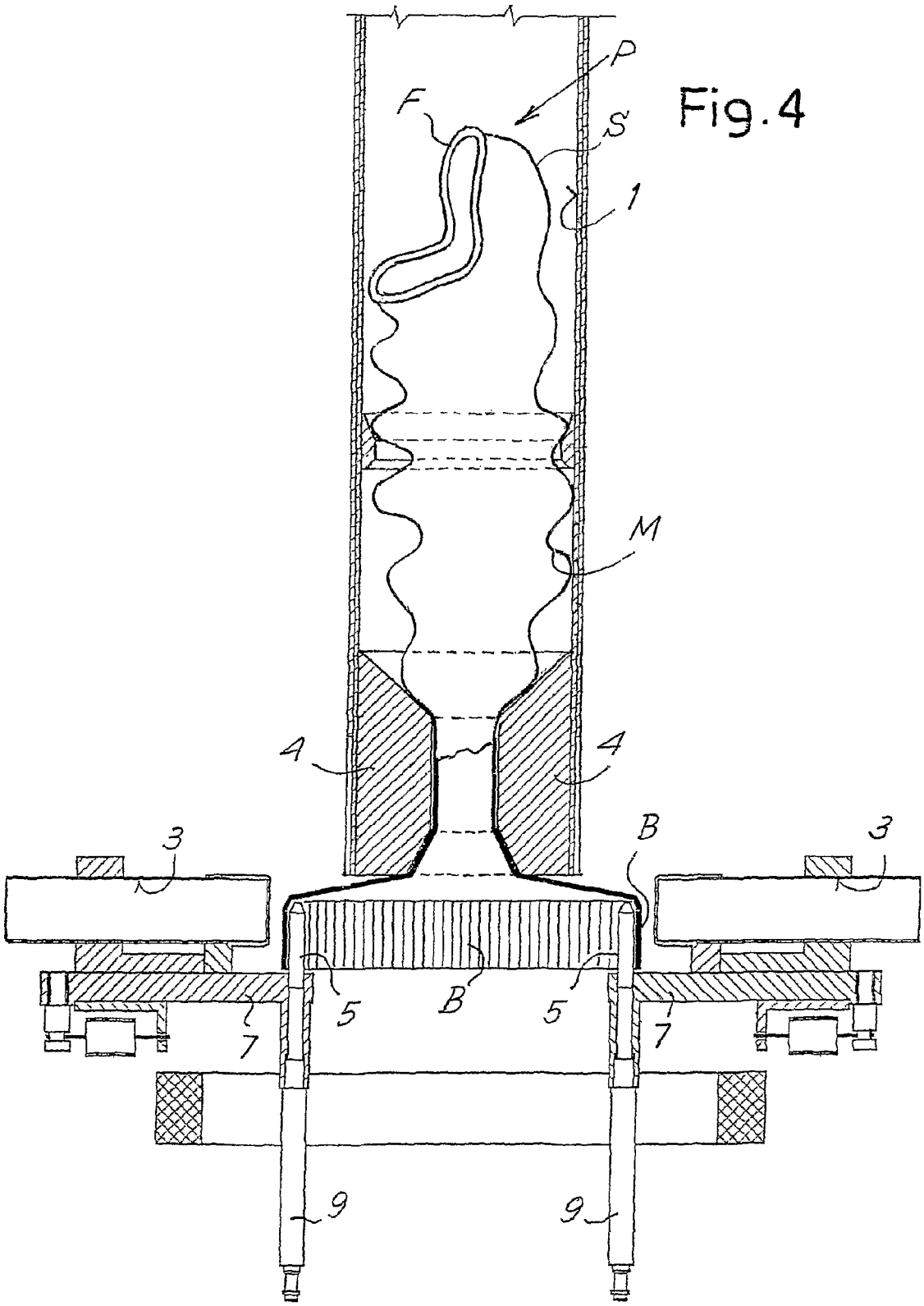
Figure 5:
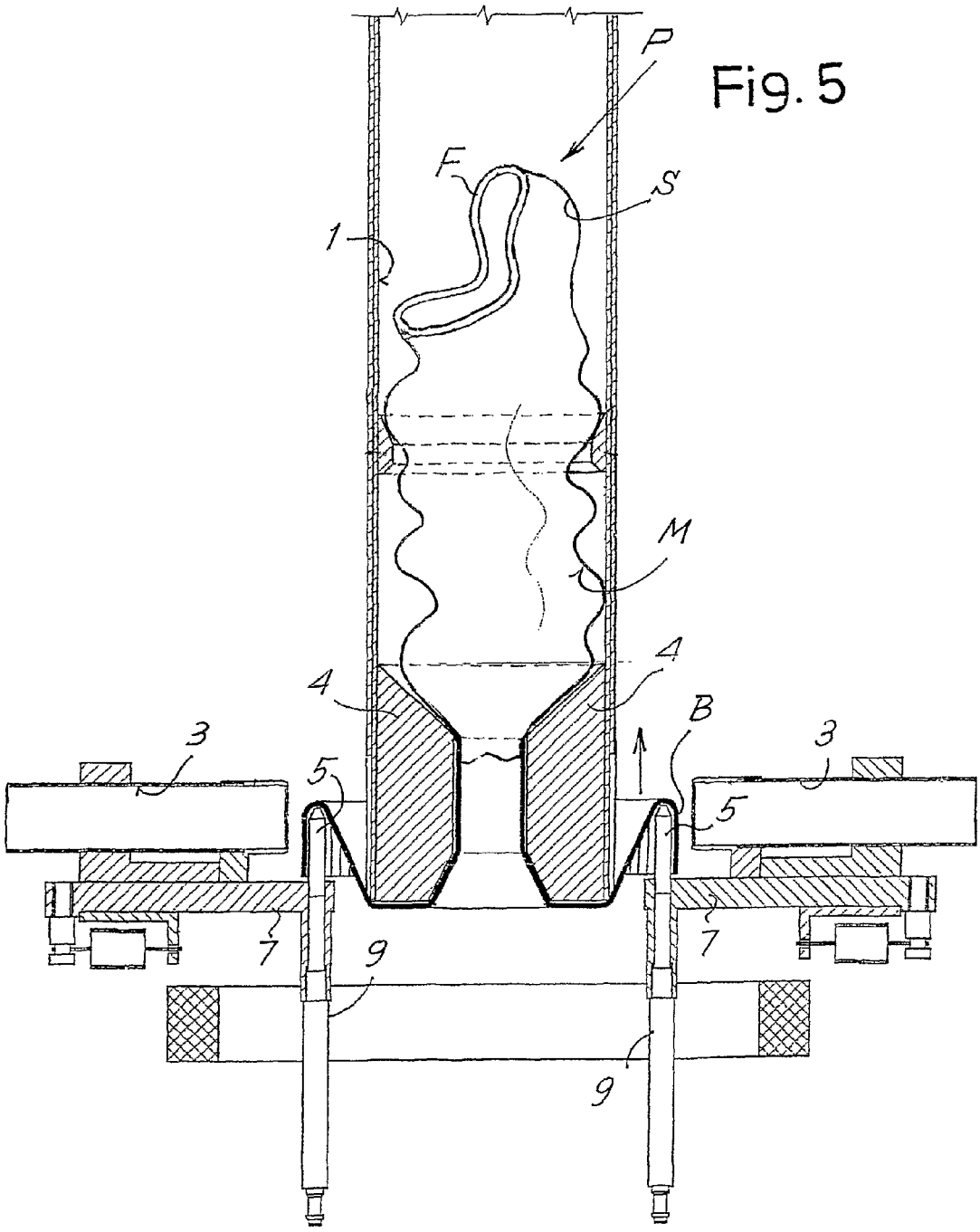
Figure 6:
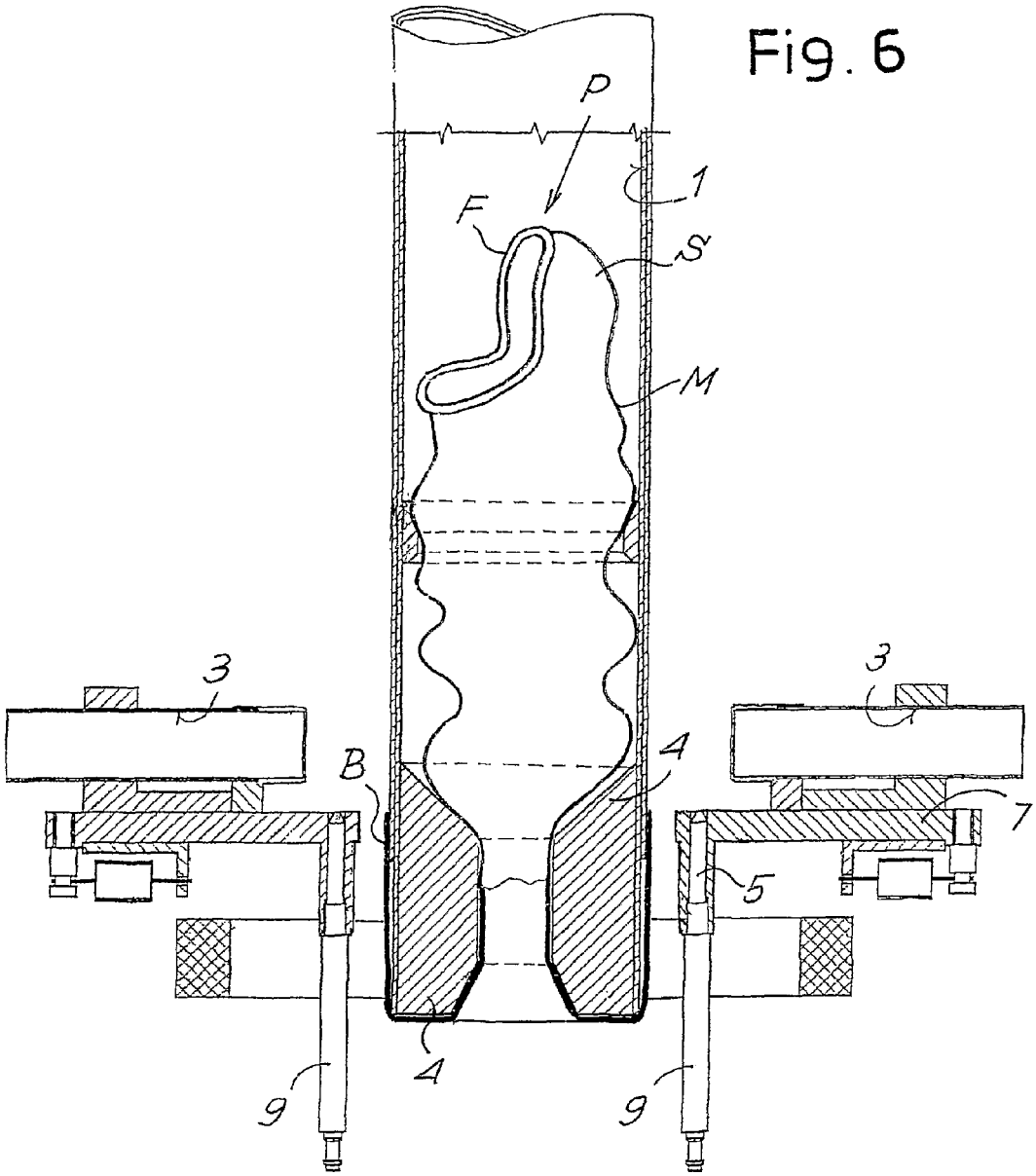

The slides 7 are moved radially outwards, drawing the pins 5, to stretch the elastic edge B of the article M to the position illustrated in FIG. 4, where the edge is outside the volume of the section of the tubular member 1. In this way (FIG. 5), with an axial movement of the slides 7 and of the pins 5 carried thereby, the article M can be reversed on the outside of the tubular member 1, to take the position shown in FIG. 6.

Figure 7:
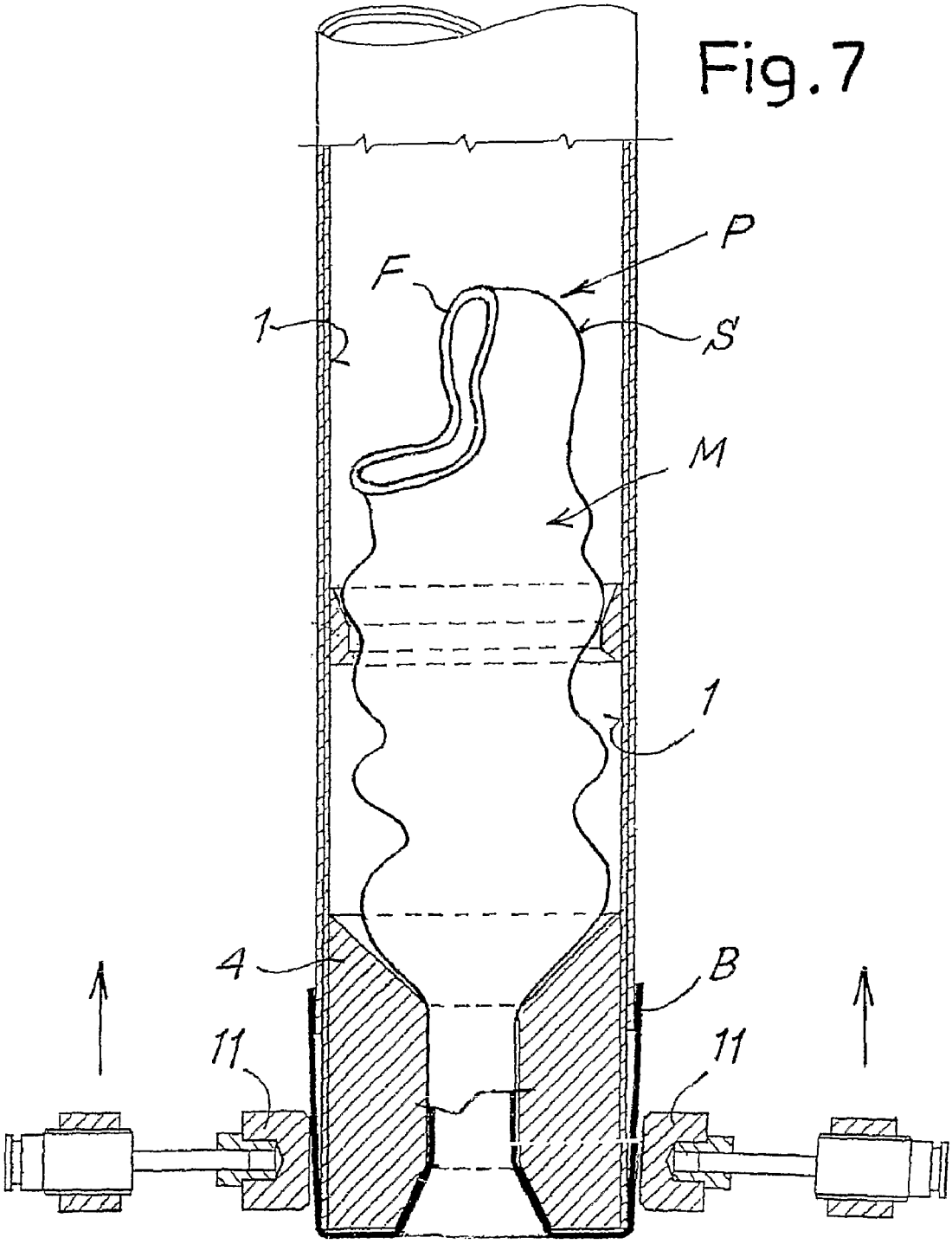
Figure 8:
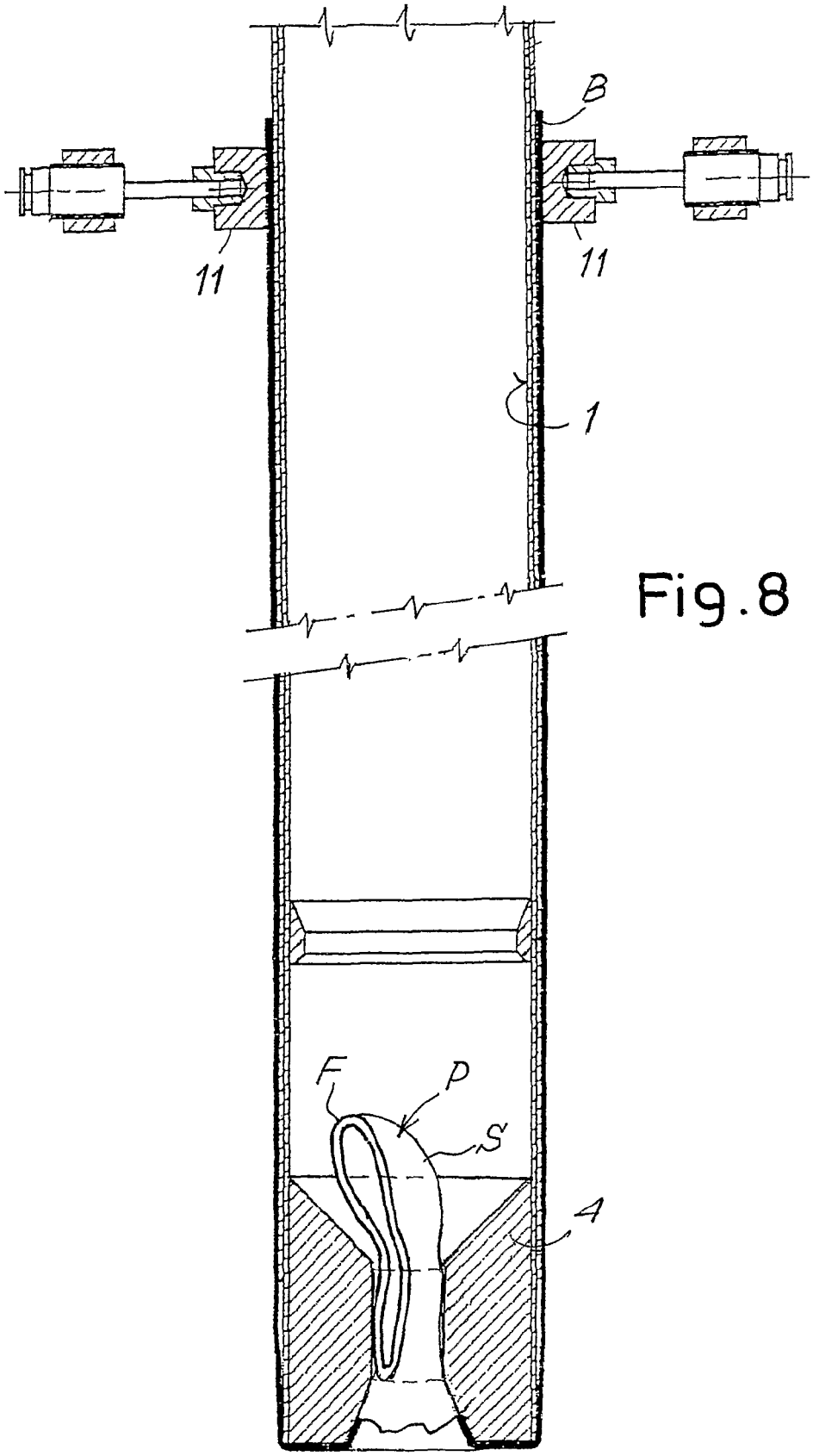

A series of pads 11 movable along the axis of the tubular member 1, by moving alternatively along said axis and opening and closing with each stroke, reverse the article M from the inside to the outside of the tubular member 1 as shown in FIGS. 7 and 8, to take the toe P of the article M to the position shown in particular in FIG. 9. In this position the pocket S of the toe of the article M is in a casual angular position outside the tubular member 1 in proximity to the opening 1A thereof, while, through the effect of the tension imparted by the pads 11 on the tubular article M, the band F—produced in elastic yarn—is disposed as shown in FIGS. 9 and 10. In particular, it can be seen that through the effect of the elasticity of this band, of the traction in an axial direction and of the shape of the pocket S of the toe P, the band F is positioned with the intermediate area thereof (indicated with F1 in FIG. 10) along a chord of the circumference represented by the edge 1A of the opening of the tubular member 1, which preferably has a circular cross section. The remaining portion F2 of the band F is positioned outside the tubular member 1, as shown in FIGS. 9 and 10.

The pocket S of the toe P is in the same angular position as the heel pocket T (if present), due to the way in which the article M was knitted. As mentioned previously, the seam to close the toe P must extend in a predetermined direction with respect to the toe pocket S and to the heel pocket T.

The method according to the invention allows the position of the pocket(s) S and T for correct orientation of the article to be sewn to be determined on the basis of the fact that the portion F1 of the band F is disposed in the position in FIGS. 9 and 10 on the tubular member 1, that is, along a chord of the closed line defined by the edge 1A.

Figure 11:
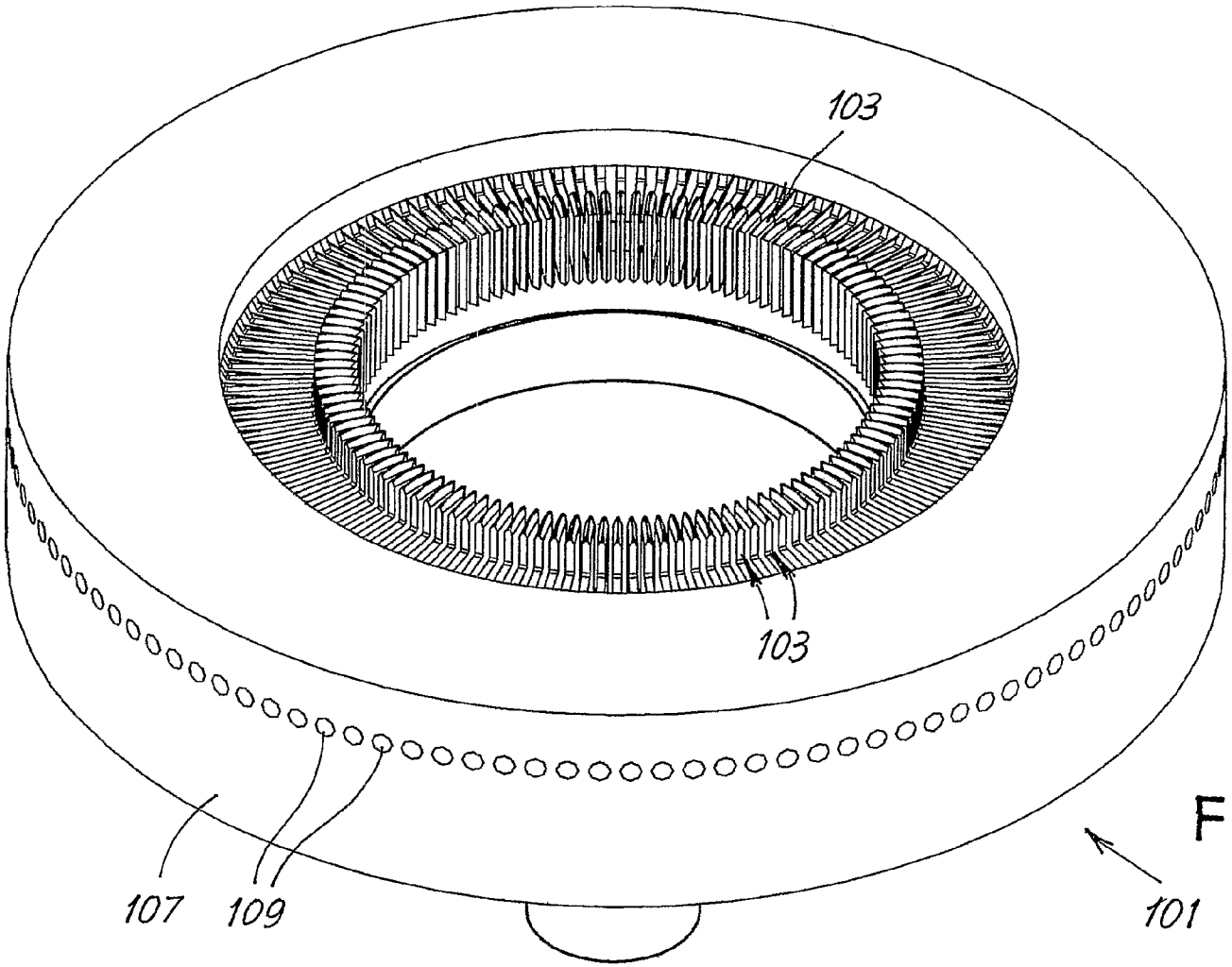
FIG. 11 shows a perspective view of the unit of sensors in an annular position.
Figure 12:
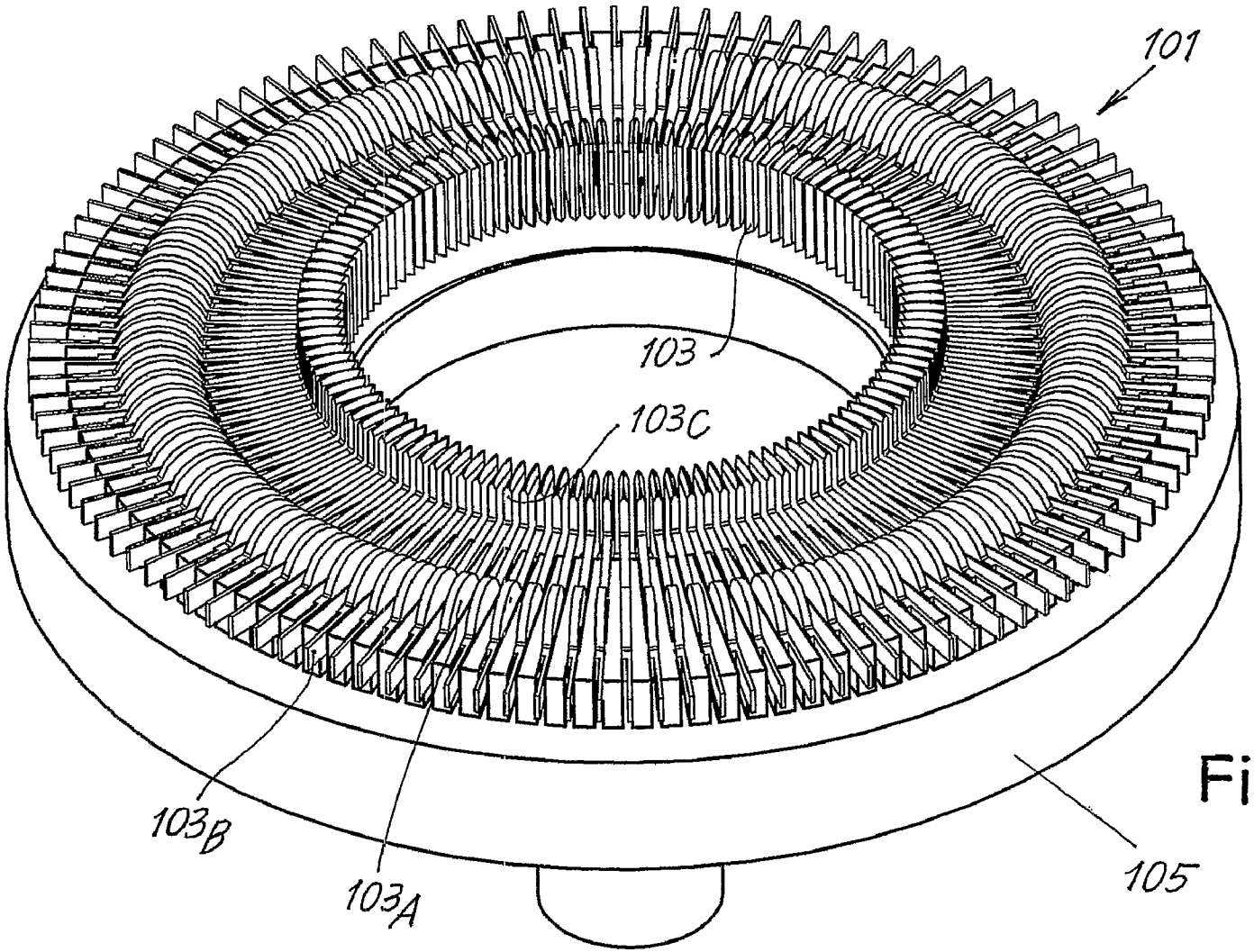
FIG. 12 shows a view analogous to the view in FIG. 11 with the seat of the sensors or electrical contacts open.
Figure 13:
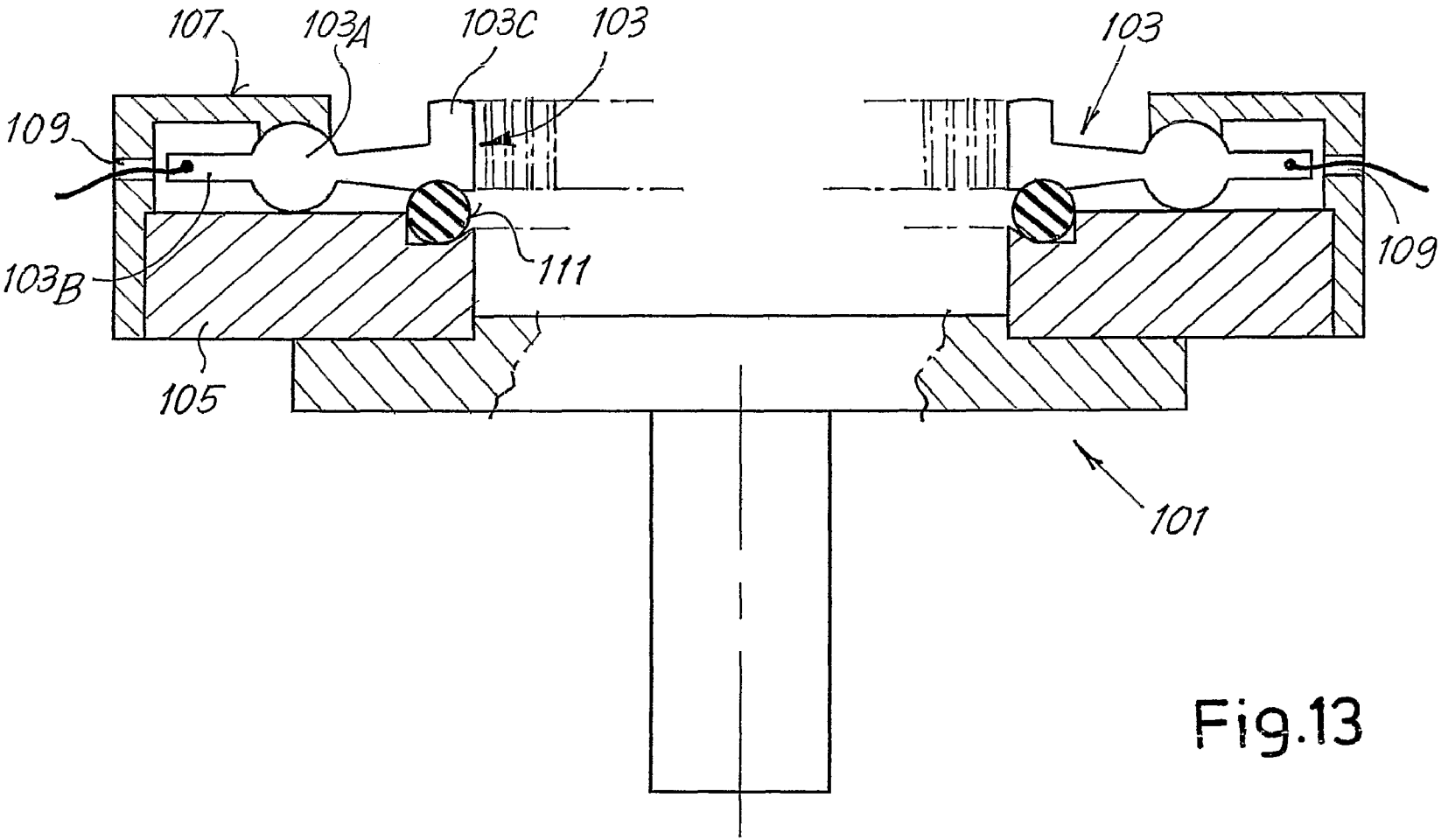
FIG. 13 shows a local section according to a diametric plane of the electrical contacts.

In order to determine the angular position of the chord along which the portion F1 of the band F is positioned, according to the preferred embodiment of the invention a group of sensors, indicated as a whole with 101, is provided positioned in front of the end of the tubular member 1 in front of the edge 1A. Provided inside the housing of the group of sensors 101 is a circular arrangement of electrical contacts, which will be described in detail with reference to FIGS. 11 to 13, with an extension corresponding substantially to the extension of the circumference represented by the edge 1A of the tubular member 1.

The electrical contacts are indicated with 103 and are arranged inside a housing in the form of an annular crown, formed of a lower ring 105 and of an annular cover 107 over it. Each electrical contact 103 is composed (see FIG. 13) by a shaped metal segment, for example obtained by shearing. Each single segment has an approximately circular central portion 103A, extending from which is an appendix 1038 in a radially outward direction and an appendix 103C in a radially inward direction.

The appendices 103B form connections for electrical wires (not shown), which lead out through holes 109 produced in the annular cover 107. Each appendix 103C is L-shaped and its free end, which extends approximately parallel to the axis of the tubular member 1, has a bevel, which defines a line of contact with the edge 1A of the tubular member 1.

Positioned under the L-shaped appendices 103C is a annular elastic gasket 111, which forms an elastic element to stress each of the electrical contacts 103.

When the article M is positioned in the arrangement in FIGS. 9 and 10, the crown of contacts 103 approaches the front edge 1A of the tubular member 1 until the ends of the inner L-shaped appendices come into contact, with the beveled corners thereof, against the edge 1A of the tubular member. The thrust exerted on the segments forming the contacts 103 causes a slight downward oscillation thereof around the center of the respective circular portions 103A with consequent elastic compression of the annular gasket 111. As a consequence of this, all the contacts 103 which are located along the arc A of circumference defined by the edge 1A of the tubular member come into contact with the tubular member, while the contacts which are positioned along the arc B are in contact with the fabric of the tubular article M. By grounding the tubular member 1, the contacts 103 along the arc A close and the contacts 103 along the arc B remain open, as they are isolated from the electrically conductive material from which the tubular member 1 is made (at least in part).

As the electrical contacts 103 are arranged with a very small angular pitch, it is thereby possible only by moving the contacts and the tubular member 1 reciprocally towards each other to identify in a single operation the position of the band F1 through identification of the contacts which are positioned between the arc A and the arc B.

The angular pitch between electrical contacts 103 is chosen as a function of the greater or lesser precision required in determining the angular position of the pocket S. If only slight precision is required, contacts that are relatively distant from one another can be used, while when high precision is required contacts positioned very close to one another can be used, as shown in the example illustrated in the drawing. The plate-like configuration of the contacts makes it possible to position the contacts very close together and therefore to obtain high precision in determining the angular position of the pocket S.

Determination of the angular position of the article M takes place very quickly without the need for any relative movement between article M, tubular member 1 and/or sensors 103. Moreover, the contacts 103 resting against the circumferential edge 1A of the tubular member 1 are also used to retain the article M against accidental slippage. Therefore, the contacts 103 can be brought into contact against the edge 1A even before the article M has been completely stretched over the tubular member. For this purpose, a series of optical sensors, for example, can be provided, which surround the tubular member 1 and which are able to identify when the article M has been inserted sufficiently to leave part of the surface of the tubular member 1 uncovered.

It would also be possible for the electrical contacts to be arranged laterally with respect to the tubular member 1, although this is less advantageous from the viewpoint of mechanical action between contacts and tubular member. However, it would also be possible to provide a crown of electrical contacts 103 with a more marked oscillating movement than the one obtainable with the aforesaid configuration, and which move towards the side surface of the tubular member 1 or the fabric of the article M inserted thereover with a radial movement. For example, the electrical contacts can be composed of elastic segments, which project from an annular crown with a diameter substantially larger than the diameter of the tubular member 1, and which is arranged to surround the tubular member 1 and the article M inserted thereover. The segments project radially towards the inside of the annular supporting crown to an extent that they interfere with the tubular member and to become deformed or oscillate radially outwards to obtain closing of the contacts against the uncovered side surface of the tubular member 1 and opening of the contacts positioned against the fabric of the article M.

In all cases the angular position of the pocket S is defined as the intermediate position between the points that divide the arcs A and B.

It is understood that the description and drawings merely show a practical embodiment of the invention, which may vary in forms and arrangements, without however departing from the scope of the concept underlying the invention.

The invention claimed is:

1. Method for handling a tubular knitted article comprising a first open end defining an elastic edge, a second open end surrounded by a band and which must be closed, to form a closed toe of the article, along a closing line having specific orientation with respect to a pocket of fabric of the article, comprising the steps of:

stretching said article over a tubular member so that an intermediate part of the band surrounding said second end is positioned along a line intersecting in two points the end edge of the tubular member and the remaining part is disposed along the outer side surface of the tubular member;

positioning a crown of detection elements along the end edge of the tubular member;

detecting the angular position of said band on the tubular member as a function of interaction between said crown of detection elements and said band;

identifying the position of the pocket of fabric on the basis of the angular position of said band with respect to the tubular member.

2. Method as claimed in claim 1, wherein said detection elements are positioned in front of the end edge of said tubular member.

3. Method as claimed in claim 1, wherein said detection is performed without reciprocal rotation between the crown of detection elements and the tubular member.

4. Method as claimed in claim 1, wherein said detection elements comprise electrical contacts cooperating with a tubular member made at least in part of an electrically conductive material.

5. Method as claimed in claim 3, wherein:

said detection elements comprise electrical contacts cooperating with a tubular member made at least in part of an electrically conductive material; said electrical contacts are all brought into contact with the tubular member and with the tubular article stretched thereover; and in that the angular position of said band is determined according to the position of the electrical contacts closed through contact with the tubular member and opened through interposing the tubular article between the contacts and the tubular member.

6. Method as claimed in claim 5, wherein said electrical contacts are made to act simultaneously on the tubular member.

7. Method as claimed in claim 1, wherein during detection the tubular member is held substantially still with respect to the tubular member.

8. Method as claimed in claim 1, wherein said tubular article is taken to a specific position with respect to the tubular member and the angular position of the tubular article is determined identifying the points of separation between the detection elements which are at the level of a surface of the tubular member covered by fabric of said tubular article and the detection elements which are at the level of a surface of the tubular member not covered by fabric of said tubular article.

9. A device for angular orientation of a tubular knitted article, comprising:

a tubular member;

an inserter designed and arranged to insert and stretch a tubular knitted article onto the outside of said tubular member and over an end thereof;

a control unit;

a crown of detection elements cooperating with said end of the tubular member, said control unit being programmed to determine the angular position of the tubular article stretched over the tubular member by reading the signal supplied by said detection elements in a specific reciprocal position of said tubular article, of said tubular member and of said detection elements.

10. Device as claimed in claim 9, wherein said detection elements are electrical contacts, the tubular member being electrically conductive.

11. Device as claimed in claim 10, wherein said electrical contacts are supported elastically.

12. Device as claimed in claim 11, wherein said electrical contacts are mounted oscillating.

13. Device as claimed in claim 9, wherein said detection elements cooperate frontally with the edge of the movable member.

14. Device as claimed in claim 9, wherein said detection elements are controlled to be brought simultaneously into contact with the tubular member or with the tubular article inserted thereover.

15. Device as claimed in claim 9, wherein said detection elements are arranged with a pitch corresponding to the precision with which the angular position of the tubular knitted article is to be defined.

16. Method as claimed in claim 2, wherein said detection is performed without reciprocal rotation between the crown of detection elements and the tubular member.

17. Method as claimed in claim 2, wherein said detection elements comprise electrical contacts cooperating with a tubular member made at least in part of an electrically conductive material.

* * * * *